United States Patent [19]

Hanaoka

[11] 4,175,876

[45] Nov. 27, 1979

[54] DRIVE MECHANISM FOR PRINTER

[75] Inventor: Seiji Hanaoka, Shiojiri, Japan

[73] Assignees: Shinshu Seiki Kabushiki Kaisha; Kabushiki Kaisha Suwa Seikosha, both of Tokyo, Japan

[21] Appl. No.: 852,001

[22] Filed: Nov. 15, 1977

[30] Foreign Application Priority Data

Nov. 15, 1976 [JP] Japan ..... 51-137151

[51] Int. Cl.[2] ..... B41J 3/12; B41J 23/14; B41J 33/04

[52] U.S. Cl. ..... 400/124; 400/216.1; 400/219; 400/220.1; 400/320; 400/328

[58] Field of Search ..... 400/124, 212, 216.1, 400/216.2, 219, 220.1, 236.1, 242, 320, 320.1, 322, 323, 328, 313, 314, 314.1

[56] References Cited

U.S. PATENT DOCUMENTS

| | | | |
|---|---|---|---|
| 2,127,812 | 8/1938 | Gabrielson | 400/236.1 X |
| 3,318,431 | 5/1967 | Lapointe et al. | 400/320 |
| 3,333,667 | 8/1967 | Nordin | 400/124 |
| 3,880,271 | 4/1975 | Hebron | 400/212 |
| 3,885,661 | 5/1975 | Okabe | 400/328 X |
| 3,891,078 | 6/1975 | Jung | 400/212 X |
| 3,929,215 | 12/1975 | Hayakawa | 400/328 X |
| 3,986,594 | 10/1976 | Kondur | 400/320 X |

OTHER PUBLICATIONS

IBM Tech. Disc. Bulletin, by M. W. Carmichael, "Print Head Transport Mechanism," vol. 18, No. 7, pp. 2330-2331, Dec., 1975.

*Primary Examiner*—Paul T. Sewell

*Attorney, Agent, or Firm*—Blum, Kaplan, Friedman, Silberman and Beran

[57] ABSTRACT

A printer including a printing head adapted for reciprocal displacement across a printing tape for effecting printing on the tape in at least one direction of reciprocation is provided. The printer includes a lever pivoted on a frame and adapted to reciprocate the printing head and a rotating disc engaged with a motor for driving the rotary disc which pivots the lever. The rotating disc is adapted to actuate a paper advance assembly, an ink-ribbon winding assembly and an ink-ribbon reversing assembly. The printing head may be of the type including a plurality of needles for recording dots by electromagnetic actuation of the needles.

42 Claims, 7 Drawing Figures

DRIVE MECHANISM FOR PRINTER

BACKGROUND OF THE INVENTION

This invention relates generally to a printer, and particularly to a miniaturized printer wherein the printing head is adapted to be displaced across a recording tape. In conventional printers including a printing head, the printing function is performed by utilizing separate complicated assemblies, such as a separate assembly for reciprocating the printing head, a separate assembly for advancing the recording tape, and a separate assembly for feeding the ink ribbon. Each separate assembly tends to increase the number of parts, increases the costs of manufacture, increases the energy required to operate each assembly and inhibits the miniaturization of a printer. Additionally, because of its large size and high price, such a conventional printer is not suitable for use in a miniaturized printer for use in a small electronic device, such as a portable electronic calculator. Accordingly, it is desirable to provide a printer which overcomes these above-noted defects.

SUMMARY OF THE INVENTION

Generally speaking, in accordance with the invention, a printer including a printing head adapted for transverse displacement across a print tape for effecting printing in at least one transverse direction is provided. The printer includes a printing head engaged with a lever for reciprocatively displacing the printing head, a rotating disc engaged with the lever for displacing the lever so as to displace the printing head, and drive means for rotating the rotating disc. The printer also includes a selectively actuatable tape advancing assembly, a continuous ink-ribbon winding assembly and ink-ribbon reversing assembly, a selectively actuatable ribbon shift and reset assembly.

Accordingly, it is an object of the invention to provide an improved printer.

Another object of the invention is to provide an improved printer having a small number of parts and simple construction.

A further object of the invention is to provide an improved printer suitable for miniaturization.

Still another object of the invention is to provide an improved rotary drive means for use in a printer.

Another object of the invention is to provide an improved paper feed and advancing assembly for a printer.

A further object of the invention is to provide an improved ink-ribbon winding and reversing assembly for a printer.

Another object of the invention is to provide an improved ink-ribbon shifting and reset assembly.

Yet another object of the invention is to provide an improved actuating assembly adapted to actuate the various assemblies in a printer.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
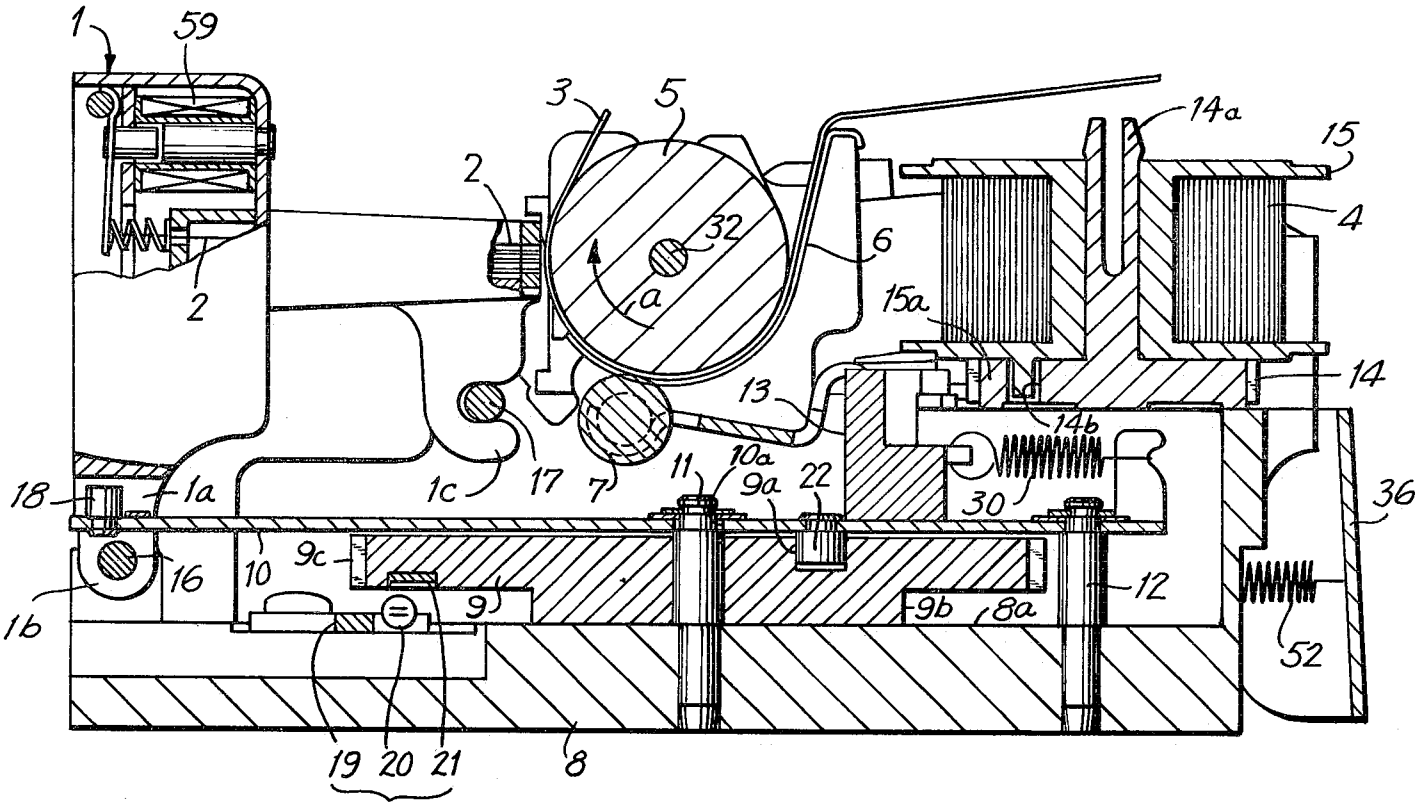
FIG. 1 is a sectional view of a printer constructed and arranged in accordance with the invention.
Figure 2:
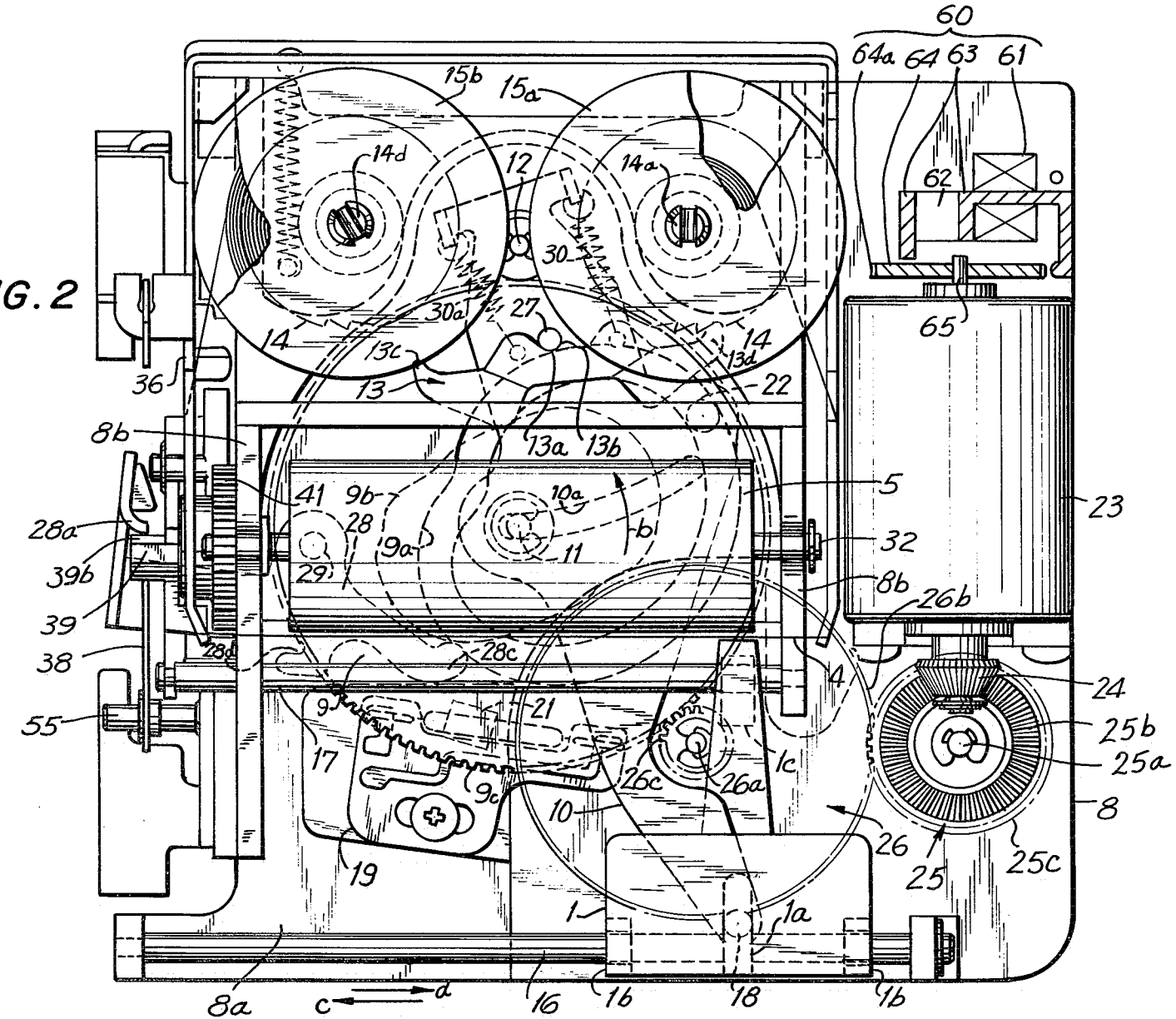
FIG. 2 is a plan view of the printer illustrated in FIG. 1.

Referring now to FIGS. 1 and 2, a printer constructed and arranged in accordance with the invention is shown. The printer includes a bottom frame 8 having an upper surface 8*a* and side frames 8*b* on which is mounted a printing head 1. Printing head 1 is arranged on frame 8 to reciprocated across the width of a recording paper 3 and prints characters thereon by operation of a plurality of needles 2 aligned longitudinally in printing head 1. Needles 2 are actuated by an electromagnetic coil 59 in printing head 1. Printing head 1 records numerals and symbols by formation of dots across paper 3 as printing head moves across paper 3. Needles 2 are displaced towards paper 3 by application of current to electromagnet 59 and strike an ink-ribbon 4 against paper 3 and a paper feeding member 5 rotatably mounted on a shaft 32 to side frame 8*b* parallel to the reciprocatory direction of printing head 1. Recording paper 3 is advanced selectively for a predetermined distance by a paper advance assembly between paper feeding member 5 and a pushing roller 7 and a paper guide 6. Each paper advance positions a new printing line on paper 3 into alignment with printing head 1. Printing head 1 is formed with a first guide portion 1*b* and a second guide portion 1*c* to engage slideably a first guide shaft 16 and a second guide shaft 17, each mounted to a portion of side frame 8*b*.

Printing head 1 is displaced across paper 3 by a rotating disc 9 mounted rotatably on a disc shaft 11 to bottom frame 8. Rotating disc 9 is formed with a cam surface 9*b* in contact with surface 8*a* of frame 8, a gear surface 9*c* about the outermost periphery thereof, and a cam groove 9*a* formed in the upper surface thereof. Rotational power is provided to rotating disc 9 to rotate in the direction indicated by an arrow b. A lever 10 is mounted rotatably on a lever shaft 12 to frame 8 at a first end of lever 10 and is positioned across rotating disc 9. An opening 10*a* is formed in lever 10 to permit lever 10 to pivot over disc 9 about shaft 12 without impinging on disc shaft 11. A camming pin 22 mounted on lever 10 projects from lever 10 to engage cam groove 9*a* for controlling the pivoting of lever 10 as rotating disc 9 rotates. When rotating disc 9 makes one revolution, pin 22 follows cam groove 9*a* and lever 10 makes one full reciprocating motion about lever shaft 12. A driving pin 18 is mounted to lever 10 at the free end thereof and engages a groove 1*a* formed in printing head 1 so that when lever 10 pivots about shaft 12 by rotating disc 9 printing head 1 is displaced across paper 3.

A ribbon winding pawl 13 formed with two engaging hook portions 13*c* and 13*d* and two concave portions 13*a* and 13*b* between engaging portions 13*c* and 13*d* is mounted by two pawl springs 30 and 30*a* to lever 10 with one of concave portions 13*a* and 13*b* in engagement with a shaft 27 fixed to lever 10. Pawl 13 and shaft 27 are positioned on lever 10 to permit selective engagement with a pair of ratchets 14 and 14*c* mounted rotatably to frame 8 for advancing a pair of ribbon spools 15*a* and 15*b* rotatably mounted on shaft 14*a* and 14*d*, respectively. The advancement and ribbon reversing by action of winding pawl 13 will be described in greater detail below.

The printer includes a position detecting assembly 31 which includes a reed switch 20 mounted on a base plate 19 which is mounted to frame surface 8*a* between frame 8 and rotating disc 9. A permanent magnet 21 is mounted in rotating disc 9 adapted to pass over reed switch 20 thereby actuating position detecting assembly 31 and produces a timing signal at each revolution of rotating disc 9.

Rotational power is provided to rotating disc 9 by a motor 23. A motor bevel gear 24 is mounted on one end of the motor shaft of motor 23 and is engaged with a beveled surface 25*b* of a first intermediate gear wheel 25 mounted rotatably about a shaft 25*a* to frame 8. First intermediate gear wheel 25 is formed further with a toothed gear surface 25*c* engaged with a first toothed gear surface 26*b* of a second intermediate gear wheel 26 mounted rotatably on shaft 26*a* to frame 8. Second intermediate gear wheel 26 is formed further with a second toothed gear surface 26*c* adapted to engage rotating disc 9 at gear surface 9*c* thereby imparting rotation to rotating disc 9 in the direction shown by arrow b.

As cam groove 9*a* forms a closed loop, when rotating disc 9 makes one revolution, lever 10 pivots about lever shaft 12 through the engagement of pin 22 in cam groove 9*a*. Driving pin 18 then engages printing head groove 1*a* and printing head 1 is displaced along guide shafts 16 and 17. Cam groove 9*a* is designed so that printing head 1 is displaced at a constant velocity in the direction indicated by the arrow c. When printing head 1 reaches the position of the end of travel along guide shafts 16 and 17, it is displaced in the direction indicated by arrow d and returns to the position shown in FIG. 2. Cam groove 9*a* is shaped so that travel in arrow direction d may be accomplished in less time than required to traverse paper 3 in direction c.

Figure 3:
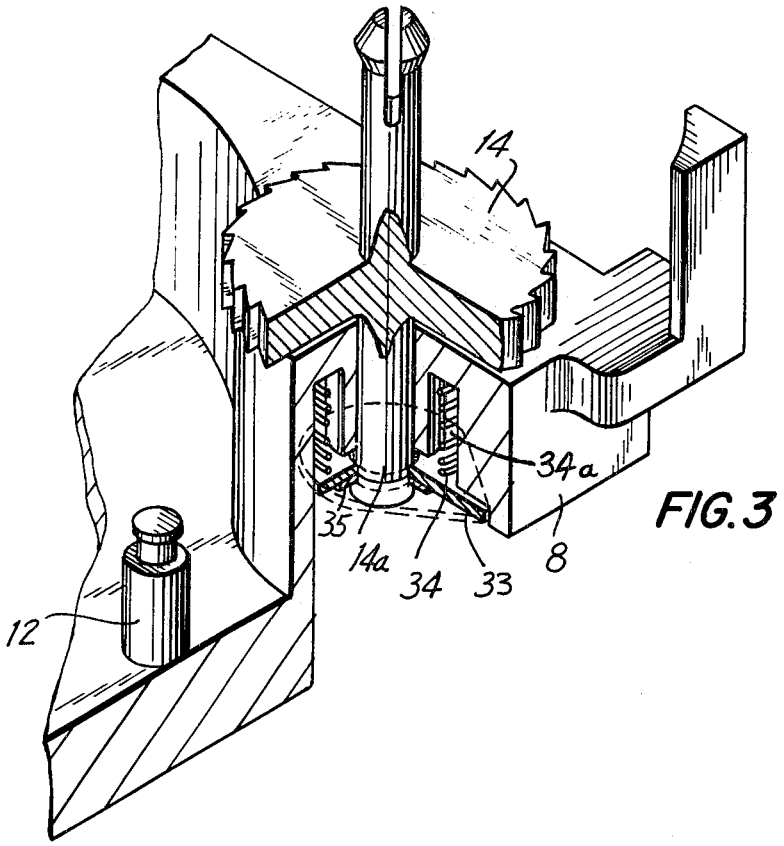
FIG. 3 is a perspective view showing the mounting of a ratchet in section utilized in the printer depicted in FIG. 1.

Referring now to FIG. 3, a portion of a ratchet assembly for winding and reversing ink-ribbon 4 is shown. The ratchet assembly includes a ratchet portion 14 fixed on ratchet shaft 14*a* which is rotatably secured to frame 8 by a stop ring 35 engaged against a projection formed in the mounted end of ratchet shaft 14*a*. A spring 34 is positioned in a channel 34*a* formed in frame 8 about the mounting hole for ratchet shaft 14*a* and a spring compression member 33 is biased between spring 34 and frame 8 on one side and stop ring 35 on the other side. By constructing the ratchet assembly in this manner, a frictional torque results between ratchet 14 and frame 8 due to the biasing action of spring 34 and prevents ink-ribbon spool 15 which is to be mounted on ratchet shaft 14*a* from turning until a sufficient force is applied by pawl engaging portion 13*c*. In addition, when ratchet 14 is not engaged by engaging portion 13*c*, ribbon 4 will not loosen.

Referring now to FIG. 2, two ribbon spools 15*a* and 15*b* having ribbon 4 wound thereon are mounted on ratchets 14 and 14*c*. Ribbon spool 15*a* is formed with a projection 15*c* for engaging an opening 14*b* formed in ratchet 14 as shown in FIG. 1, so that ribbon spool 15 rotates in cooperation with ratchet 14. Ribbon 4, winding and unwinding between spools 15*a* and 15*b*, is guided by a ribbon frame 36 and travels from one ribbon spool to the other by passing over and parallel with paper feeding member 5.

Ribbon 4 is wound on the ribbon spools in the following manner. As lever 10 pivots about shaft 12 towards first ribbon spool 15*a* which is depicted as the winding spool in FIG. 2, shaft 27 is engaged with pawl concave portion 13*a* so that pawl engaging portion 13*d* is engaged with ratchet 14 thereby rotating first ribbon spool 15*a* in the winding (counterclockwise) direction. Pawl engaging portion 13*d* maintains engagement with ratchet 14 by action of spring 30 and 30*a* and advances the winding ribbon 4 on ribbon spool 15*a* mounted on ratchet 14*a* each time lever 10 pivots about shaft 12 as pin 22 follows groove cam 9*a*.

When ribbon 4 is wound completely on first ribbon spool 15*a* and pawl engaging portion 13*d* engages pawl 14 the pawl assembly will not rotate due to the force exerted by ribbon 4, the end of which is secured to second ribbon spool 15*b*. Due to this force, pawl 13 shifts engagement with shaft 27 so that shaft 27 engages concave portion 13*b* thereby disengaging pawl engaging portion 13*d* from ratchet 14. As lever 10 pivots about shaft 12 in the direction (clockwise) toward ratchet 14*c*, pawl engagement portion 13*c* engages ratchet 14*c* by action of springs 30 and 30*a* and second ribbon spool 15*b* becomes the winding spool. This ribbon reversing process occurs at the completion of ribbon winding in each direction.

By constructing the ratchet assembly in this manner in accordance with the invention, ribbon 4 is wound intermittently by engagement of engaging portions 13*c* and 13*d* of pawl 13 mounted on lever 10 so that ribbon 4 may be wound slowly. The energy required for this process is slight when compared to continuous winding used in conventional printers. Moreover, loosening of ink ribbon 4 is slight due to the frictional torque applied to each ratchet 14 and 14*c* by springs 34.

Figure 4B:
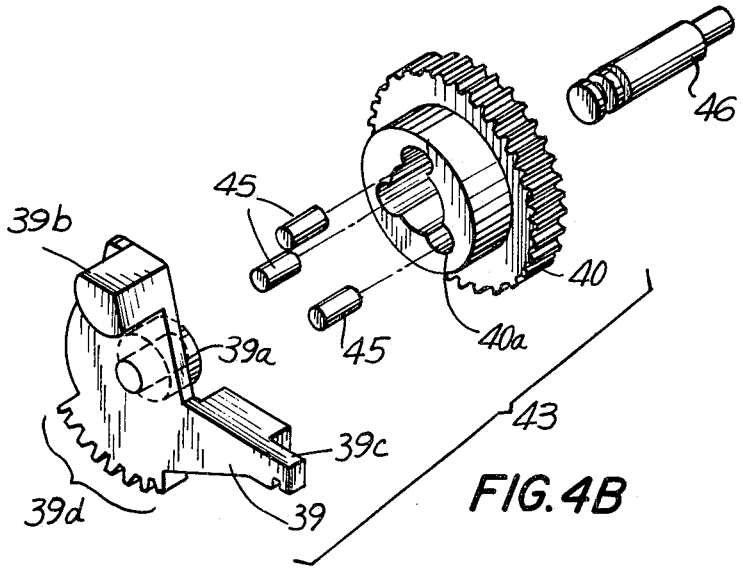
FIG. 4*b* is an exploded perspective of a clutch assembly utilized in the paper advance assembly illustrated in FIG. 4*a;*
Figure 4A:
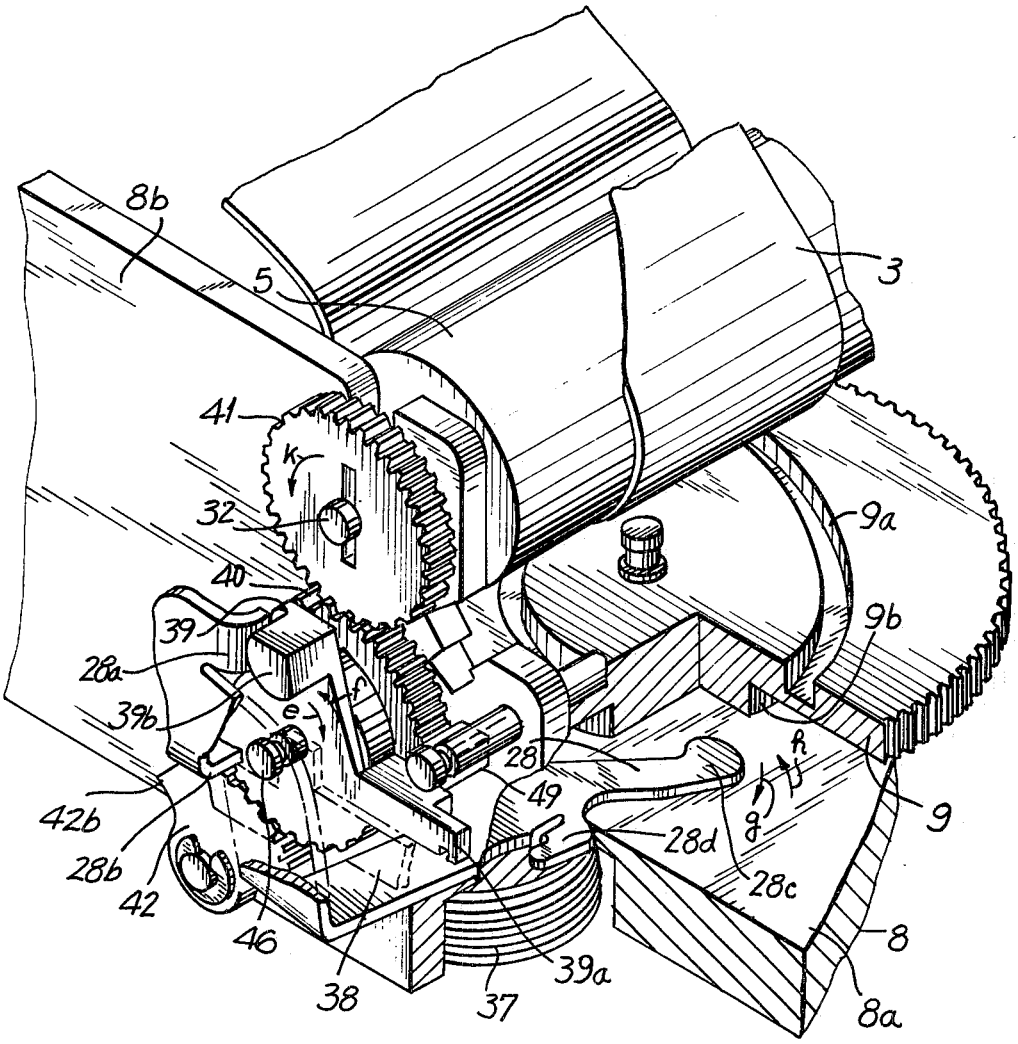
FIG. 4*a* is a perspective view illustrating a paper advance assembly and drive means in section utilized in the printer depicted in FIG. 1.

Referring now to FIGS. 2 and 4*a*, a transmitting lever 28 is mounted pivotally on a shaft 29 to frame 8. Transmitting lever 28 is formed with a cam follower portion 28*c* for following cam 9*b* formed on rotating disc 9, a spring retaining finger 28*d* on one arm and a transmitting finger 28*a* and a trigger stop portion 28*b* on the other arm. A spring 37 mounted at one end to frame 8 and at the other end to finger 28*d* imparts a constant biasing force to transmitting lever 28 as indicated by an arrow h as cam follower portion 28*c* follows cam 9*b* of rotating disc 9. Transmitting lever 28 is pivoted in the direction indicated by an arrow g about shaft 29 due to the displacement by cam 9*b* whereby spring 37 is compressed and trigger finger 28*b* of transmitting lever 28 engages a trigger lever 38 shown in phantom.

Figure 5:
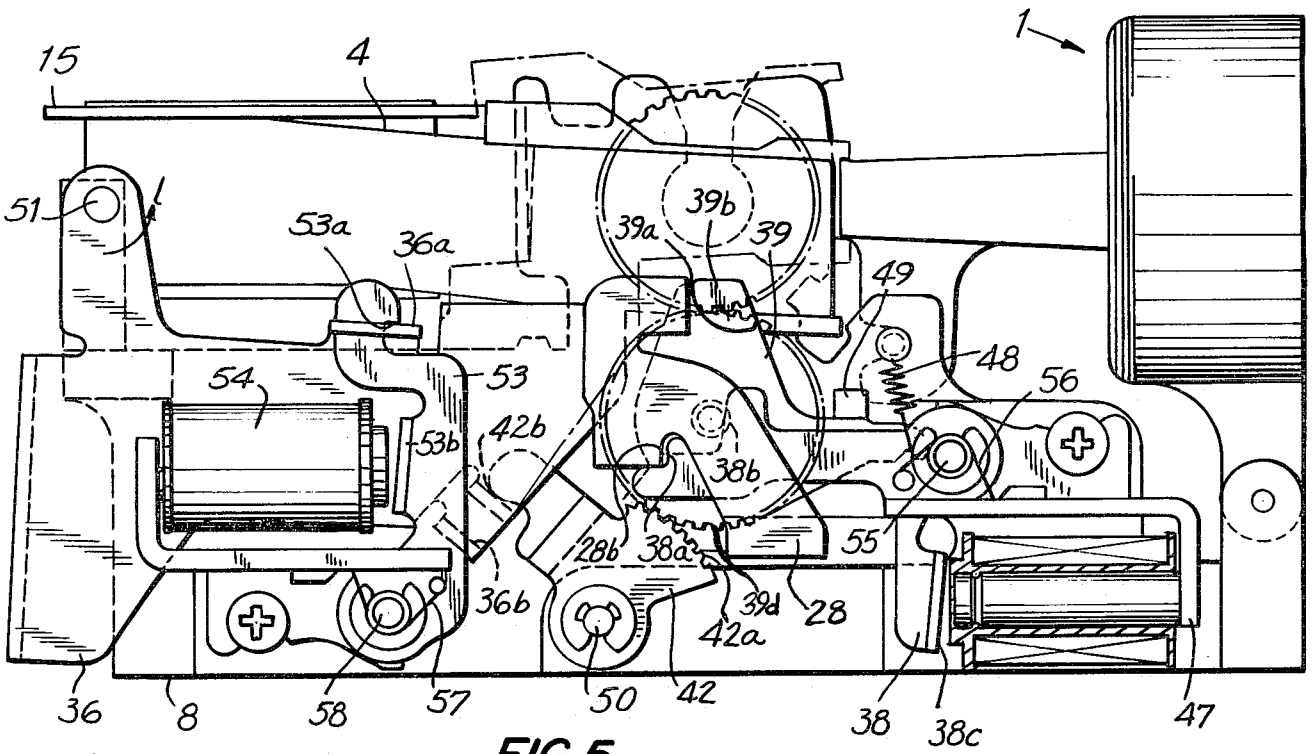
FIG. 5 is a side elevational view of the printer illustrated in FIG. 1.

Referring now to FIG. 5, trigger lever 38 formed with a first stop portion 38*a* and a second stop portion 38*b* for engagement with engaging portion 28*b* of transmitting lever 28 is shown mounted rotatably on a shaft 55 to side frame 8*b*. An electromagnetic assembly 47 is actuatable selectively to attract trigger lever arm 38*c* so as to deflect trigger lever 38 towards electromagnet 47 about shaft 55. This deflection disengages engaging portion 28*b* of transmitting lever 28 from first trigger stop portion 38*a*. As transmitting lever 28 is biased in the direction indicated by arrow h due to the biasing force of spring 37 and the shape of cam 9*b*, transmitting lever 28 deflects thereby causing transmitting finger 28*a* of transmitting lever 28 to engage a projection 39*b* formed on a driving member 39 of a clutch assembly 43 illustrated in FIG. 4*b*. As shown in FIG. 5, transmitting lever 28 deflects until it engages second stop portion 38*b* of trigger lever 38. Trigger lever 38 is biased away from electromagnet 47 abutting a stopper 49 mounted on said frame 8*b* by a leaf spring 56 mounted about shaft 55 and secured to trigger member 38.

Referring now to FIG. 4*b*, clutch assembly 43 includes driving lever 39 formed with projection 39*b*, a clutch shaft collar 39*a*, a projecting arm 39*c* and a toothed geared portion 39*d*, three friction rolls 45, and a driven gear wheel 40 formed with a gearing surface for engagement with a paper feed gear 41 mounted to paper feed shaft 32 and holes 40*a* for receiving friction rolls 45. Clutch assembly 43 includes a clutch shaft 46 for rotatably mounting driving lever 39 and driven gear wheel 40 thereon to side frame 8*b*. Friction rolls 45 are inserted into holes 40*a* about clutch shaft 46 so that when driving member 39 is rotated in arrow direction e as shown in FIG. 4*a* by transmitting member 38, friction rolls 45 engage the outer surface of clutch shaft collar 46 and driven gear wheel 40 thereby rotates driven gear wheel 40 in the same direction about clutch shaft 46. When trigger member 38 is deflected by actuation of electromagnet 47, transmitting lever engaging portion 28*b* is released from engagement with trigger lever stop portion 38*a*, transmitting lever 28 pivots about shaft 29 and transmitting portion 28*a* engages driving lever 39 at projection 39*b* rotating driving member in arrow direction e. Driving lever 39 rotates driven gear wheel 40 by action of friction rolls 45 thereby rotating paper feed gear wheel 41 in the direction indicated by an arrow k about paper feed shaft 32 to advance paper 3 a predetermined amount. Driving lever 39 is biased by clutch spring 48 and returns to its original position abutting a stopper 49 when cam follower portion 28*c* of transmitting lever rotates in an arrow direction g by action of cam surface 9*b*. Driven gear wheel 40 does not rotate in this direction as holes 40*a* are formed to allow friction rolls 45 to rotate freely in this direction without engaging with clutch shaft collar 39*a*. Thus, clutch assembly 43 operates as a one-way clutch with driven gear wheel 40 rotating only in arrow e direction when driving lever 39 rotates in the direction of arrow e. When driving lever 39 rotates in the direction of arrow f, driven gear wheel 40 does not rotate and no paper is fed during this rotation or cocking of spring 37.

As noted above, only when trigger lever 38 is deflected by selective actuation of electromagnet 47 does transmitting lever 28 cause driving lever 39 to rotate about shaft 46 thereby advancing a predetermined amount of paper 3 by rotation of paper feeding member 5. When driving lever 39 returns to its at rest position abutting stopper 49, operation of one-way clutch assembly 43 does not permit driven gear wheel 40 to rotate. As shown in FIG. 2, cam 9*b* is formed with two matching cam surfaces, thereby permitting paper 3 to be fed twice intermittently while rotating disc 9 undergoes one revolution.

Driving lever 39 is also formed with a toothed geared surface 39*d* in engagement with a reset lever 42 rotatably mounted on a reset lever shaft 50 to frame 8*b*. As driving lever 39 is rotated reciprocatively, reset lever 42 rotates in cooperation therewith and transmitting lever 28. Operation of reset lever 42 will be described in more detail with respect to the description of FIG. 5.

Referring now to FIG. 5, ribbon frame 36 is mounted pivotally on a supporting shaft 51 to side frame 8*b* and guides ink ribbon 4 unwinding from one ribbon spool to the other ribbon spool between printing head 1 and paper 3. A shift spring 52, shown in FIG. 1, is secured at one end to ribbon frame 36 and at the other end to frame 8 imparting a bias to ribbon frame 36 in the direction shown by an arrow 1. Ribbon frame 36 is formed with a first engaging finger 36*a* and a second engaging finger 36*b* for controlling rotation about supporting shaft 51. When ink ribbon 4 is provided with two colors, that is with one color along the top length and a second color along the bottom length, it is possible to print the upper color when printing head 1 is in the position shown by the solid line. A suppression lever 53 is mounted pivotally on a lever shaft 59 to frame 8 and is formed with a stop portion 53*a* and a magnetic portion 53*b*. Suppression lever 53 is biased by a spring 57 in the direction away from electromagnet 54 so that stop portion 53*a* engages first engaging portion 36*a* of ribbon frame 36. An electromagnet 54 is mounted on frame 8 and is adapted to engage selectively magnetic portion 53*b* of suppression lever 53 thereby disengaging first engaging portion 36*a* of ribbon frame 36 and stop portion 53*a* of suppression lever 53. Ribbon frame 36 rotates in arrow direction 1 until second stop portion 36*b* of ribbon frame 36 engages a stop finger 42*a* formed on reset lever 42. At ribbon shift this positions the lower portion of ink ribbon 4 is aligned with printing head 1 thereby allowing the print characters to be printed in the color of the lower portion of ink ribbon 4. When second stop portion 36*b* of ribbon frame 36 engages finger 42*a* of reset lever 42, driving lever 39 is in the non-actuated position indicated by arrow f in FIG. 4*a*. As driving lever 39 abuts stopper 49 in this position the gear interaction between driving lever 39 and reset lever 42 fixes the limit of rotation of ribbon frame 36 thereby accurately positioning ribbon 4 so that a color along the lower portion may be printed. This ribbon shift position of ribbon frame 36 is shown in the two-point dash line in FIG. 5.

The shifted ribbon is reset as follows. When engaging portion 28*b* of transmitting lever 28 is released from engagement with first stop portion 38*a* of trigger lever 38 by the selective actuation of electromagnet 47, transmitting lever 28 rotates in arrow direction h about shaft 29 rotating driving lever 39 in arrow direction e about shaft 46 to advance paper 3. Driving lever 39 which is in gear engagement with reset lever 42 causes reset lever 42 to rotate about shaft 50 thereby causing reset lever finger 42*a* to drive second stop portion 36*b* of ribbon frame 36 to its original position thereby re-engaging first curved portion 36*a* with engaging portion 53*a* of suppression lever 53 which has returned to original position by deactivation of electromagnet 54 and action of spring 57. At this time ribbon frame 36 is returned to and locked into its original printing position. As this operation occurs during a paper advancing rotation of transmitting lever 28 in arrow direction h and ribbon frame 36 is reset simultaneously with advancement of paper 3.

Figure 6:
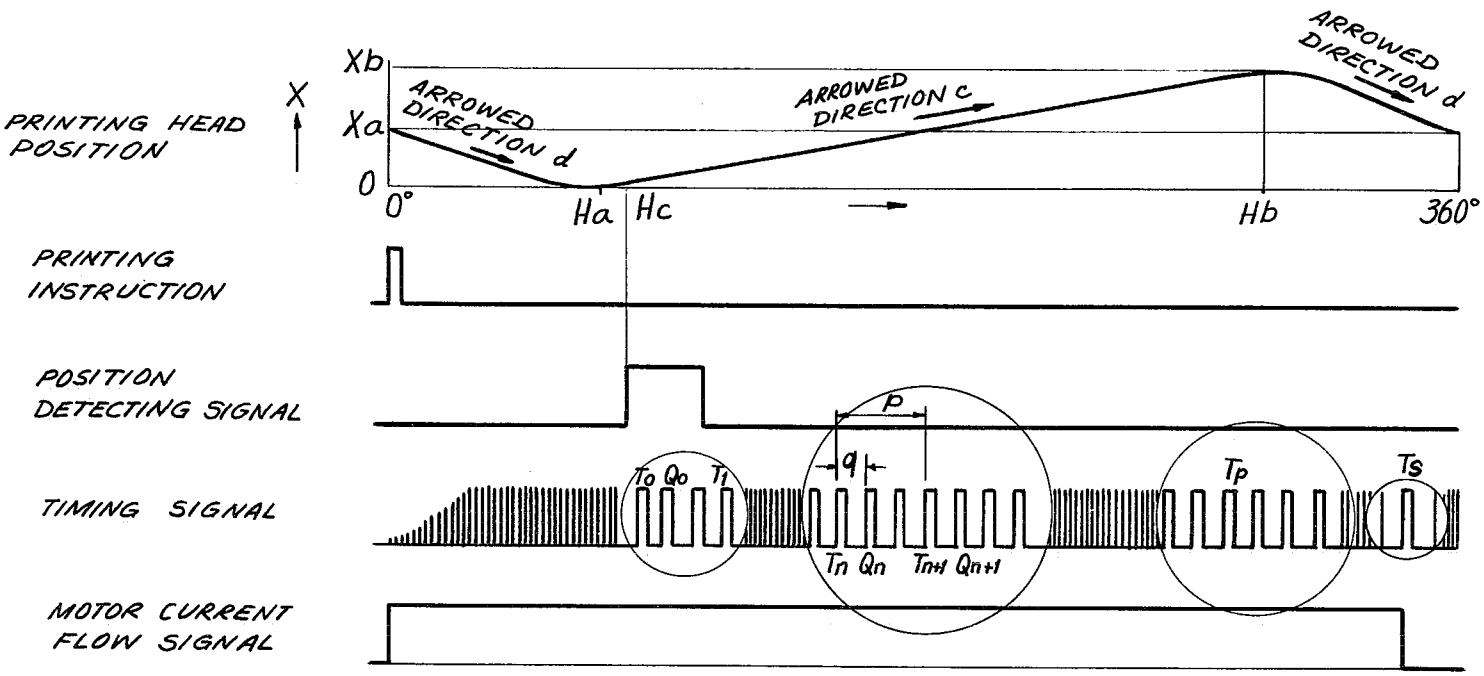
FIG. 6 is a time and chart diagram illustrating the displacement and printing cycle of the printing head assembly of the printer depicted in FIGS. 1–5.

Referring now to FIG. 6, a timing detection assembly 60 mounted to frame 8 and motor 23 is shown. Timing detection assembly 60 includes a disc 64 fixed to motor shaft 65 which extends from the other end of motor 23 on which motor beveled gear 24 is mounted. Disc 64 is formed from a material of high permeability and is formed with at least one projection 64*a* about the periphery thereof. A detection magnet 62 formed of a permanent magnet and detection coil 61 are mounted to a yoke 63 which is fixed to frame 8 for completing the circuit of magnetic flux produced by detection magnet 62.

Referring now to FIG. 6, a timing chart illustrating the position X of printing head 1 is illustrated. The position of printing head 1 at the right hand extreme of its travel along guide shafts 16 and 17 in FIG. 2 is represented as O and at the right hand extreme as $X_b$. When the printer is not actuated and printer head 1 is at rest, printing head 1 is positioned at the position $X_a$ or midpoint of its travel and the rotational angle H of rotating disc 9 is represented by 0.

When current to motor 23 is turned on and a printing instruction is provided to the printer control circuit (not shown) rotation of motor 23 is transmitted to rotation in arrow direction b of rotating disc 9 by the gear arrangement between motor bevel gear 24, first intermediate gear wheel 25 and second intermediate gear wheel 26. Printing head 1 is displaced in arrow direction d from position $X_a$ by operation of pin 22 mounted to lever 10 following groove cam 9*a* on rotating disc 9. When rotating disc 9 rotates to an angle $H_a$, printing head 1 arrives at the end of its travel in arrow direction d and changes its direction to arrow direction c. By this time motor 23 is rotating at constant velocity and the timing signal provided by detection coil 61 indicates a constant voltage level as shown. Printing head 1 travels in arrow direction c at a constant linear velocity except at the extreme ends of its path of travel at position O and position $X_b$. Thus, during all other portions of its travel, the linear velocity is constant and the printing operation may be performed. Reed switch 20 and permanent magnet 21 mounted on rotating disc 9 have been placed in predetermined positions, so that a position detecting signal is produced by reed switch 20 at a rotational angle of rotating disc 9 indicated at $H_c$ to indicate when the velocity of printing head 1 in arrow direction c reaches constant velocity.

Because the rotation of motor 23 and displacement of printing head 1 are in cooperation mechanically, the timing signal produced immediately after the front edge of the position detecting signal may be represented as $T_0$ and if counting is successive, the timing signal and position X of printing head 1 may be maintained in correspondence. Printing actuation may occur approximately during the period when rotation angle H of rotating disc 9 changes from $H_a$ to $H_b$. The printing time for one dot printed by the printing head 1 is taken as corresponding to the interval indicated as p of timing signal $T_n$ to $T_{n+1}$ or about 3 times the unit pulse interval q. Thus, projections 64*a* are provided on disc 64 at equal intervals so as to produce a timing signal which equally divides by three the printing time of one dot by printing head 1. When a signal is provided to print a dot at time $T_n$ current is provided to electromagnetic coil 59 for a unit interval q from time $T_n$ to $Q_n$. Here, the timing signal was produced so as to divide equally the interval from $T_n$ to $T_{n+1}$ by three. However, it is also possible to divide equally the interval into any integer. Similarly, the width of current flow was provided equal to the unit pulse interval q, but it is also possible to provide current flow for any integer times a unit pulse interval. Moreover, a timing signal produced immediately after the front edge of the position detecting signal was represented as $T_0$, but is is possible to provide a timing signal after counting any arbitrary number.

When a timing signal separating $T_n$ from $T_{n+1}$ is not utilized, it is necessary to control the length of current flow to the coil of electromagnet 59 by a circuit, such as a single stable multi-vibrator utilizing $T_n$ as a standard. In such cases, as the fluctuation of length of current flow increases, the stability of actuation decreases.

When the current to motor 23 is turned off, motor 23 will rotate for a short period of time. Taking into consideration the number of these revolutions, the current flow signal of the motor is turned off by a timing signal so that printing head 1 will come to rest at its initial position $X_a$. The timing and length of current flow to electromagnet 47 for displacement of suppression lever 53 also are controlled utilizing an arbitrary timing signal $T_p$ or $T_s$ as the standard.

In accordance with the above description of the printer illustrated in FIGS. 1–5, the printer operates as follows. When a print signal is received by the printer from a print control circuit (not shown) motor 23 turns on causing motor shaft 65 to rotate. This rotation of motor shaft 65 actuates timing detection means 60 thereby generating timing signals as illustrated in FIG. 6.

The motor rotation is transmitted to rotating disc 9 in arrow direction b by rotation of motor bevel gear 24 of first intermediate gear wheel 25 and second intermediate gear wheel 26. As rotating disc 9 rotates pin 22 is engaged with groove cam 9*a* causing lever 10 to reciprocate pivotally about lever shaft 12 sliding printing head 1 along guide shafts 16 and 17 first in arrow direction d and then in arrow direction c, continuously traversing paper 3.

As rotating disc 9 rotates, one engaging portion of pawl 13 will engage one ratchet member in the winding direction of that ratchet thereby winding ribbon 4 on the winding spool mounted on that ratchet. As described above, when winding in this direction is completed, tension of ribbon 4 causes pawl 13 to shift engagement with pawl shaft 27 from one concave portion to the other thereby engaging the other ratchet due to biasing force from spring 30. This other ratchet now becomes the winding ratchet and ribbon 4 is wound in the opposite direction. This ribbon winding reversal occurs at the end of each ribbon winding cycle.

As rotating disc 9 rotates, transmitting lever 28 is cocked continuously about shaft 29 in arrow direction g due to the action of cam follower portion 28*c* following cam 9*b* and engagement of engaging portion 28*b* and trigger first stop portion 28*b*. Thus, transmitting lever 28 does not displace driving lever 39 until trigger member 38 is deflected by a signal to electromagnet 47. When trigger member 38 is deflected by actuation of electromagnet 47, transmitting finger 28*a* displaces driving lever 39 in the direction indicated by arrow e when transmitting lever 28 is pivoted in paper advance arrow direction h thereby engaging one-way clutch assembly 43 rotating drive gear 40 and paper feed gear 41 thereby advancing paper 3 a predetermined distance.

As transmitting lever 28 pivots in the arrow direction g as it follows cam 9b driving lever 39 returns to its at rest position abutting stopper 49 without rotating driven gear 40 due to the operation of one-way clutch assembly 43. Thus, paper 3 is advanced selectively by the selective actuation of electromagnet 47 whereby trigger member 38 is deflected.

Driving lever 39 is in engagement with reset lever 42 thereby causing reset lever 42 to pivot continuously about shaft 50 each time driving lever 39 is pivoted about shaft 46. As ribbon frame 36 is maintained in its initial print position until suppression lever 53 is pivoted by actuation of electromagnet 54, reset lever 42 does not contact second engaging portion 36b of ribbon frame 36. When electromagnet 54 is actuated by a signal and suppression lever 53 is pivoted about shaft 59, first engaging finger 36a is released from engagement with stop portion 53a, second engaging portion 36b engages stop finger 42a of reset lever 42. As paper 3 is fed when driving lever 39 is pivoted, reset lever 42 in engagement therewith forces ribbon frame 36 to its first print position. If electromagnet 54 has been deenergized, stop portion 53a will re-engage with first engaging portion 36a thereby securing ribbon frame 36 to its first position. Thus, the shifted ribbon is returned to its first print position at the same time paper 3 is advanced. However, ribbon frame 36 may be maintained in its shifted position during printing of successive print lines when electromagnet 54 remains energized.

Accordingly, by constructing and arranging a printing with a drive means including a rotating disc, paper feeding, ribbon winding and reversing and ribbon shift assemblies may be effectively controlled and operated by the rotating disc. As all these assemblies are regulated by the position of rotating disc and actuation of electromagnets, the total number of parts required for the printer is reduced, thereby reducing the cost and energy requirements and permitting size reduction of the printer. Such printers are particularly well suited for use in small electronic devices, such as portable calculators.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A printer for printing characters on recording tape means by impacting printing means into an ink ribbon against the tape means comprising;

a frame;

disc means rotatably mounted to said frame;

lever means pivotally mounted to said frame and operatively engaged with said disc means for reciprocatively pivoting said lever means in response to rotation of said disc means;

printing means slideably mounted to said frame and engaged with said lever means for reciprocative displacement across the tape means in response to pivoting of said lever means for effecting printing in at least one direction of said displacement;

tape feeding means mounted to said frame and cooperatively engaged with said disc means for incrementally feeding said tape means at least in part in response to rotating of said disc means; and ribbon winding means mounted to said frame and operatively coupled to said lever means for incrementally winding said ribbon means at least in part in response to pivoting of said lever means.

2. The printer of claim 1, including ribbon reversing means mounted on said lever and coupled to said ribbon winding means for reversing the direction of said ribbon winding means.

3. The printer of claim 2, including ribbon shift means, mounted on said frame for selectively shifting the position of a ribbon from a first print position to a second print position for printing by impacting said printing means on a different portion of said ribbon against said tape.

4. The printer of claim 3, wherein said ribbon shift means includes reset means engaged with said recording tape feeding means and adapted to be actuated upon the selective advancement of said recording tape feeding means for returning said ribbon to its first print position.

5. The printer of claim 1, wherein said printing means is a printing head including print character means for printing characters on said recording tape, said printer including guide means on said frame for guiding said printing head during displacement thereof.

6. The printer of claim 5, wherein said guide means includes at least one guide shaft mounted to said frame and said printing head includes at least one guide portion for slideably engaging said printing head on said guide shaft.

7. The printer of claim 6, including two guide shafts mounted to said frame and said print head including two guide portions for slideable engagement of said printing head and said guide shafts.

8. The printer of claim 5, wherein said print character means is a plurality of print needles mounted in said printing head, adapted to be actuated selectively as said print head reciprocates on said guide shaft.

9. The printer of claim 8, wherein said print needles are aligned longitudinally for effecting printing of characters during displacement of said printing head.

10. The printer of claim 9, wherein said print head includes electromagnetic means for actuating said print needles.

11. The printer of claim 1, wherein said disc means includes continuously rotating cam means and said recording tape feeding means includes transmitting means pivotally mounted on said frame, said rotating cam means engageable with said transmitting means for the pivotable displacement of said transmitting means between first and second positions spaced at different distances from the axis of rotation of said cam means for at least in part actuating said recording tape feeding means.

12. The printer of claim 11, wherein said recording tape feeding means includes trigger means mounted to said frame for selectively retaining said transmitting means at its first position spaced the greatest distance from said cam means axis, and means biasing said transmitting means toward its second position into engagement with said cam means when released by said trigger means.

13. The printer of claim 12, wherein said recording tape feeding means includes recording tape feeding roller means and one-way clutch means mounted on said frame, said clutch means operatively coupling said recording tape feeding roller means and transmitting means for rotating said roller only in a feeding direction upon selective displacement of said transmitting lever from one of said first and second positions to the other of said first and second positions.

14. The printer of claim 13, wherein said recording tape feeding roller means includes a recording tape feeding roller fixed to a roller shaft rotatably mounted to said frame and a roller gear fixed to one end of said roller shaft, said roller gear being in engagement with said clutch means.

15. The printer of claim 14, wherein said trigger means includes a trigger lever, electromagnetic means for selective displacement of said trigger lever from a first position in retaining engagement with said transmitting means to a second position at which said transmitting means is free to pivot in response to said biasing means toward the second position of said transmitting means, and further means biasing said trigger lever toward its first position.

16. The printer of claim 15, wherein said one-way clutch means includes a clutch shaft mounted rotatably on said frame, a driving lever mounted on said clutch shaft, a plurality of friction rolls mounted on said clutch shaft between said driving lever and said clutch shaft, a driven gear formed with a plurality of friction roll holes, said driven gear being mounted rotatably on said clutch shaft and said friction rolls inserted into said friction roll holes, said friction rolls and friction roll holes adapted to rotate said driven gear in response to rotation of said driving lever from a first position to a second position only and said friction roll holes adapted to allow said friction rolls to rotate freely when said driving lever is rotated from its second position to its first position, said driven gear being operationally coupled to said recording tape feeding roller means.

17. The printer of claim 1 wherein said ribbon winding means includes ratchet means rotatably mounted on said frame and operatively coupled to said ribbon supply means, said ratchet means disposed on said frame to be operatively engaged by said lever means for advancing said ribbon on said ribbon supply means in response to pivoting of said lever means.

18. The printer of claim 17, wherein said ribbon supply means includes two spools for the supply of ribbon therebetween, said ribbon winding means including a first and second of said ratchet means each coupled to one of said spools, one of said ratchet means adapted to be engaged by reciprocation of said lever means for winding an ink-ribbon on said spool means mounted on said engaged ratchet means.

19. The printer of claim 18, wherein said ratchet means includes a ratchet shaft rotatably mounted to said frame, a ratchet mounted on said shaft and spring means for biasing said ratchet to said frame.

20. The printer of claim 19, wherein each said ribbon spool is mounted on the associated ratchet shaft in engagement with the associated ratchet.

21. The printer of claim 1, wherein said rotating disc means is formed with lever engaging means for engaging said lever means.

22. The printer of claim 21, wherein said lever engaging means includes camming means for reciprocating said lever means.

23. The printer of claim 22, wherein said camming means is a non-circular groove cam adapted to cooperate with said lever means.

24. The printer of claim 23, wherein said lever means is an elongated lever pivotally mounted to said frame and formed with a first pin for engaging said drive means.

25. The printer of claim 24, wherein said lever is formed further with a second pin adapted to cooperate with said printing means for the displacement thereof.

26. The printer of claim 1, wherein said lever means is an elongated lever pivotally mounted to said frame and formed with a first pin for operatively engaging said disc means.

27. The printer of claim 26, wherein said lever is formed further with a second pin adapted to cooperate with said printing means for the displacement thereof.

28. The printer of claim 18, wherein said lever means includes pawl means mounted thereon for engaging one of said ratchet means for advancing said ribbon.

29. The printer of claim 28, wherein said pawl means is a pawl formed with two engaging portions for defining two positions of engagement of said pawl on said lever means, said pawl engaging a first of said ratchets at one engagement position and the second of said ratchets at the other engagement position.

30. The printer of claim 29, wherein said lever means includes a pawl shaft for engagement of said pawl, said pawl engaging portions being a pair of spaced concave region therein and including pawl spring means for biasing said pawl into engagement with said pawl shaft.

31. The printer of claim 30, wherein each end of a ribbon is fixed to one of said ribbon spools so that when said winding is complete on the one ribbon spool driven by said pawl, said one spool is loaded and the engagement between the ratchet of said end spool and said pawl shifts engagement of said pawl so that said pawl shaft is shifted from one concave engaging portion to the other concave portion whereby said pawl engages the other ribbon spool ratchet for winding on the associated spool when said lever reciprocates.

32. The printer of claim 3, wherein said ribbon shift means includes ribbon frame means for guiding said ribbon and adapted to be selectively displaced to said second print position.

33. The printer of claim 32, wherein said ribbon frame means is a ribbon frame pivotally mounted for displacement between a first position and a second position, means biasing said ribbon frame toward its second position and shift trigger means for selectively holding said ribbon frame in its first position and for selectively releasing said ribbon frame to prevent displacement to its second position.

34. The printer of claim 33, wherein said ribbon shaft means includes reset means adapted to engage said ribbon frame at said second position and return said ribbon frame to its first position for retension by said shift trigger means.

35. The printer of claim 34, wherein said reset means is a reset lever adapted to engage said ribbon frame when in its second position, said reset lever being operatively coupled to said recording tape feeding means whereby said reset lever returns said ribbon frame to said first position when said feeding means is actuated.

36. The printer of claim 1, including a motor engaged with said rotating disc means and position detecting means for determining the angle of rotation of said rotating disc means.

37. The printer of claim 36, wherein said position detecting means comprises a reed switch and permanent magnet.

38. The printer of claim 37, including timing detection means engaged with said motor for generating timing signals for said printer.

39. The printer of claim 1, wherein said disc means rotates continuously and at constant speed during printing.

40. A printer for printing characters on recording tape means by impacting printing means into an ink ribbon against the tape means comprising:

a frame;

disc means having cam means thereon and rotatably mounted to said frame;

lever means pivotally mounted to said frame and operatively engaged with said disc means for reciprocatively pivoting said lever means in response to rotation of said disc means;

printing means slideably mounted to said frame and operatively engaged with said lever means for reciprocative displacement across the tape means in response to pivoting of said lever means for effecting printing in at least one direction of said displacement;

tape feeding means including transmitting means pivotally mounted on said frame and engageable with said cam means for the pivotal displacement of said transmitting means between first and second positions spaced at different distances from the axis of rotation of said cam means, trigger means mounted to said frame for selectively retaining said transmitting means at its first position spaced for the greatest distance from the axis of said cam means and means for biasing said transmitting means toward its second position into engagement with said cam means when released by said trigger means, for at least in part actuating the incremental advancement of said tape feeding means; and ribbon winding means mounted to said frame and operatively coupled to said lever means for incrementally winding the ribbon at least in part in response to pivoting of said lever means.

41. The printer of claim 40 including guide means mounted to said frame for guiding said printing head during said displacement across the tape means.

42. A printer for printing characters on recording tape means by impacting printing means into an ink ribbon against the tape means comprising:

a frame;

disc means having cam means thereon and rotatably mounted to said frame;

lever means pivotally mounted to said frame and operatively engaged with said disc means for reciprocatively pivoting said lever means in response to rotation of said disc means;

printing means slideably mounted to said frame and operatively engaged with said lever means for reciprocative displacement across the tape means in response to pivoting of said lever means for effecting printing in at least one direction of said displacement, including a printing head, a plurality of printing needles aligned longitudinally in said printing head and electromagnet means mounted in said printing head for selectively activating said printing head in response to energizing said electromagnet means to displace said printing needles towards said tape means for effecting printing of characters during displacement of said printing head across the tape means;

tape feeding means including transmitting means pivotally mounted on said frame and engageable with said cam means for the pivotable displacement of said transmitting means between first and second positions spaced at different distances from the axis of rotation of said cam means, trigger means mounted to said frame for selectively retaining said transmitting means at its first position spaced the greatest distance from the axis of said cam means and means for biasing said transmitting means toward its second position into engagement with said cam means when released by said trigger means, for at least in part actuating the incremental advancement of said tape feeding means; and ribbon winding means mounted to said frame and operatively coupled to said lever means for incrementally winding the ribbon at least in part in response to pivoting of said lever means.

* * * * *